United States Patent [19]

Verchere

[11] Patent Number: 5,036,990

[45] Date of Patent: Aug. 6, 1991

[54] STORAGE DEVICE COMPRISING STACKABLE, NESTABLE AND SUSPENDIBLE TRAYS

[75] Inventor: Maurice Verchere, Oyonnax, France

[73] Assignee: Injectaplastic, Martignat, France

[21] Appl. No.: 386,237

[22] Filed: Jul. 28, 1989

[30] Foreign Application Priority Data

Jul. 29, 1988 [FR] France ..... 88 10310

[51] Int. Cl.[5] ..... A47F 5/00

[52] U.S. Cl. ..... 211/88; 211/113; 211/126

[58] Field of Search ..... 211/86, 88, 113, 126, 211/186; 206/509, 511, 512; 220/19

[56] References Cited

U.S. PATENT DOCUMENTS

| | | | |
|---|---|---|---|
| 933,517 | 9/1909 | Worcester | 211/126 |
| 1,089,845 | 3/1914 | Long | 211/126 |
| 2,360,218 | 10/1944 | Gavin | 211/126 X |
| 2,490,269 | 12/1949 | Johnson | 211/126 |
| 4,456,125 | 6/1984 | Chop | 211/126 X |
| 4,473,155 | 9/1984 | Howitt . | |

FOREIGN PATENT DOCUMENTS 2125372 3/1984 United Kingdom .

*Primary Examiner*—Alvin C. Chin-Shue
*Assistant Examiner*—Sarah A. Lechok
*Attorney, Agent, or Firm*—Oblon, Spivak, McClelland, Maier & Neustadt

[57] ABSTRACT

The storage device comprises a plurality of identical trays (1, 2) substantially parallelepipedal in shape and open at the upper and front sides. The trays can be nested, stacked on top of one another and suspended below a horizontal supporting element. The device comprises removable U-shaped connecting members (3, 4, 5) and locking elements (17, 18, 19, 20) integral with the lower and upper ends of the wings of the front frame (10) of the tray (1, 2), so that the stacking in a secure manner of two trays (1, 2) is performed by means, on the one hand, of the elements for locking the two front frames which cooperate with one another and, on the other hand, of the removable connecting members inserted between the rear parts of the walls of the trays.

9 Claims, 2 Drawing Sheets

STORAGE DEVICE COMPRISING STACKABLE, NESTABLE AND SUSPENDIBLE TRAYS

The present invention relates to a storage device consisting of one or more identical nestable, stackable and suspendible trays, and of means of assembly for stacking and/or suspending the trays.

Mutually nestable storage trays are known. Each tray is equipped with two U-shaped hooks for its suspension below a horizontal shelf. However, these trays cannot be used in superposition on top of one another to form a stack of trays for multi-layered storage.

Storage trays which can additionally be stacked on top of one another also exist. The stackable trays are trays equipped with means enabling them to be piled on top of one another and also preventing the displacement of the piled trays in the horizontal plane with respect to one another. It is known, for example, to stack two identical trays which are substantially parallelepipedal in shape with two open sides, using a pair of U-shaped hooks and a pair of clips which cooperate with the trays.

Conventional storage trays have a certain number of disadvantages, in particular the large number of fixing members (two clips and two U-shaped hooks) in order to stack two trays on top of one another, which increases the risk of losing these members and also the difficulty in assembling the trays; the mechanical connections between stacked trays are provided solely by U-shaped hooks and clips which have to withstand considerable mechanical stresses; these trays have grooves inside which serve as housings for the branches of U-shaped hooks and are difficult to get at during cleaning.

The object of the present invention is to eliminate all these disadvantages by providing a storage device having nestable, stackable and suspendible trays, the assembly of which is easy and simplified.

A further object of the present invention is to provide a tray with a profile which is specially adapted to be used in a storage device of the invention.

The storage device according to the invention comprises a plurality of identical trays, substantially parallelepipedal in shape, which can be nested and stacked in a secure manner on top of one another and suspended below a horizontal supporting element. It also comprises means of assembly for stacking and/or suspending the trays. Each tray consists of a horizontal base surrounded by lateral walls and a rear wall and of a U-shaped front frame, the wings of which form front ends of the lateral walls.

According to the invention, the means of assembly comprise removable connecting members and locking elements integral with the upper and lower ends of the wings of the front frame of the tray, so that the stacking in a secure manner of two of the said trays is performed by means, on the one hand, of the elements for locking the two front frames which cooperate with one another and, on the other hand, of the removable connecting members inserted between the rear parts of the walls of the two trays.

According to a preferred embodiment of the invention, the removable connecting members consist of identical elongated U-shaped hooks with substantially parallel branches. The lateral walls of the trays each comprise on the outer side a horizontal upper housing and a horizontal lower housing in order to receive the branches of the U-shaped hooks, so as to stack the tray using only two hooks which cooperate with the lateral sides of the said trays. The branches of each hook are introduced from the rear side into a lower housing of the top tray and into a corresponding upper housing of the bottom tray.

Each lateral tray wall is equipped at its upper end with a horizontal rim curved back towards the outside of the tray. The wings of the front frame are each equipped, at their upper part, with a front opening which permits the reception of a hook branch, so as to permit the suspension of the tray under a horizontal board by means of two hooks, each cooperating with the rim of a lateral wall through the corresponding front opening and with the upper surface of the horizontal board.

Each tray preferably has two rounded connecting edges joining the base and the lateral walls, the concave faces of the connecting edges each serving as a bearing surface for one of the hook branches introduced into the corresponding lower housing.

Each hook advantageously has two identical branches, each of them consisting of a frustoconical head followed by a narrowed part and a straight part of regular and constant section. The housings on the lateral walls of the trays are preferably of circular section and equipped with ribs preventing the excessive displacement of the hooks in the housings.

According to an advantageous embodiment of the invention, the front frames of the trays each contain a depression at each lower corner which, during the assembly of the trays, can come to rest on the corresponding upper rim of the lower tray serving as a bearing surface. The front frame contains in each depression an L-shaped vertical lug and at the upper end of each wing a slot cooperating with one of the lugs of the upper tray, so that the horizontal part of the L-shaped lug introduced inside the slot contributes to the suspension of the lower tray.

The upper rims of the lateral walls of the tray may be provided with vertical perforations, so that the tray can be fixed to the lower surface of the supporting element by means of screws cooperating with the said perforations.

The lateral and rear walls of the tray may be of openwork design. Preferably, the storage device is made of moulded plastic with the locking elements integrally moulded. The base of each tray may have patterns in order to limit the undesirable sliding of the objects stored in the trays.

The invention will be better understood by studying the detailed description of one particular exemplary embodiment given by way of example, which is in no way limiting, and illustrated by the accompanying drawings, in which.

Figure 1:
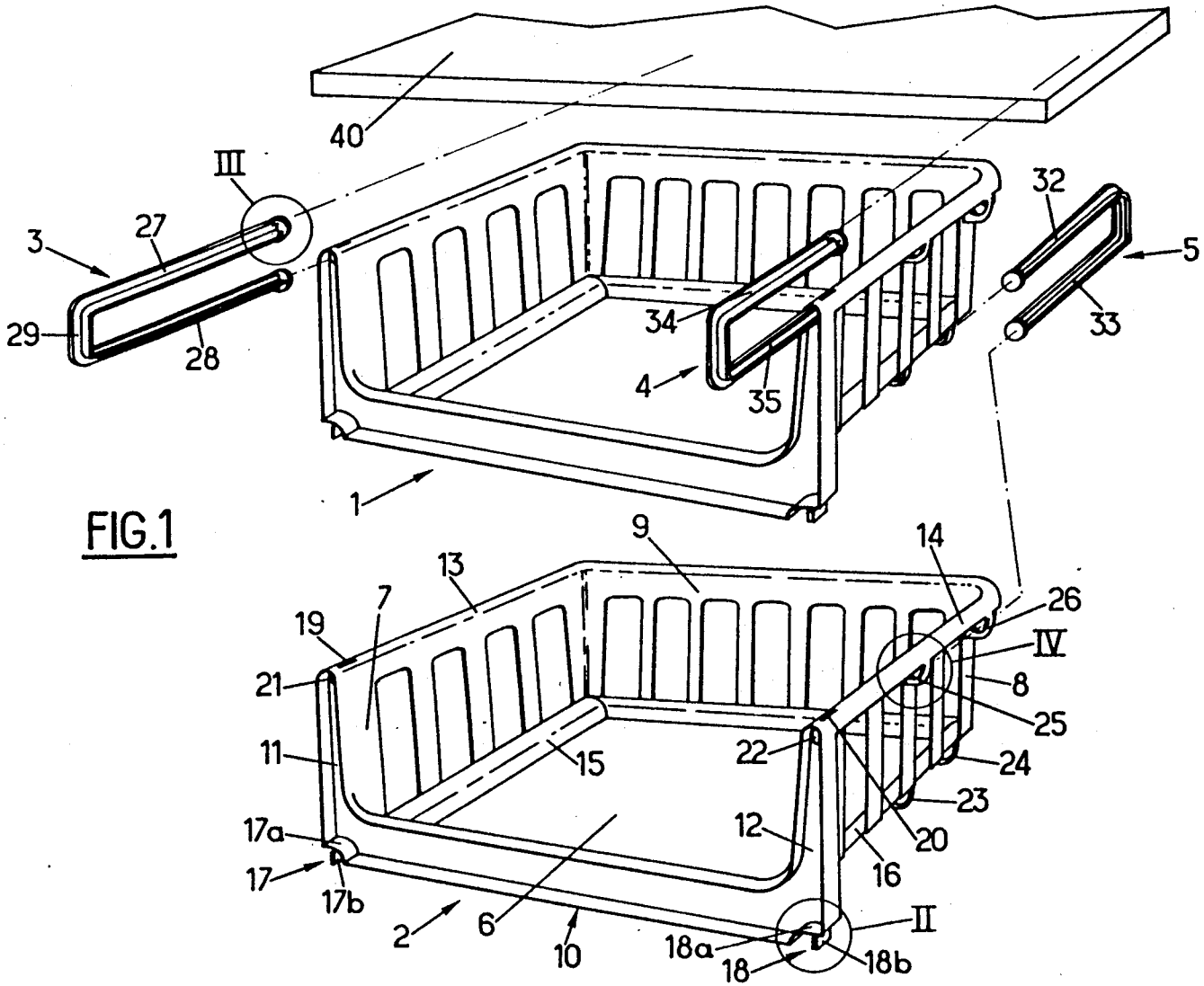
FIG. 1 is an exploded view of the storage device of with two storage trays.

As shown in FIG. 1, the storage device comprises an upper tray 1, a lower tray 2 and a plurality of elongated U-shaped hooks 3, 4 and 5. The trays 1 and 2 are identical and substantially parallelepipedal in shape.. The hooks 3, 4 and 5 are also identical.

In order to simplify the description and facilitate comprehension of the invention, only one tray and one hook will be described in detail.

By way of example, the lower tray 2 will be described. It consists of a horizontal base 6 surrounded by two open-worked lateral walls 7 and 8 and an open-worked rear wall 9, and of a U-shaped front frame 10, the wings 11 and 12 of which form front ends of the lateral walls 7 and 8. The front frame 10 and the rear wall 9 constitute the front and rear sides of the tray, respectively.

The lateral walls 7, 8 and the rear wall 9 are slightly splayed towards the top. Each lateral wall 7, 8 has at its upper end a horizontal rim 13, 14 curved back towards the outside of the tray and is joined at the base 6 of the tray by a connecting edge 15, 16.

Figure 2:
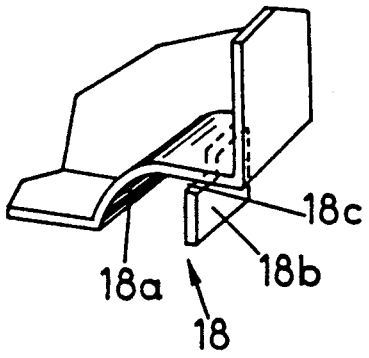
FIG. 2 is a detailed view of the part II of FIG. 1.

The front frame 10 of the tray comprises, at the U-shaped lower corners, identical locking elements 17 and 18. The locking element 18, shown in greater detail in FIG. 2, consists of a rounded concave depression **18*a* and an L-shaped lug 18*b* arranged vertically with the horizontal part of the L directed towards the front of the tray and defining a slot 18*c* with the wall of the depression 18*a***.

The wings 11 and 12 of the front frame 10 of the tray each contain, at their upper end, a slot 19, 20 emerging at the top along the corresponding upper rim 13, 14 and a front opening 21, 22, of circular profile, communicating with the concave face of the same upper rim 13, 14.

Figure 4:
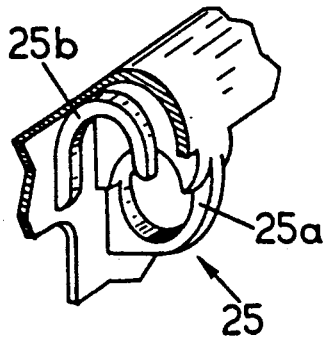
FIG. 4 is a detailed view of the part IV of FIG. 1.

Each of the connecting edges 15, 16 of the tray comprises, on its concave face, two lower eyelets 23 and 24 which form, together with the concave face of the connecting edge, a lower housing. Each of the upper rims 13, 14 of the tray comprises, on its concave face, two upper eyelets 25 and 26 which form an upper housing. The lower eyelets 23 and 24, as well as the upper eyelets 25 and 26, are spaced out along the concave face of the edges and rims, respectively. The eyelets 24 and 26, situated towards the rear of the tray, are substantially annular. The central eyelets 23 and 25, situated towards the centre of the respective edge and rim, each consist of a substantially annular part, identical to the eyelet 24 and the eyelet 26, respectively, and of a rib offset towards the front of the tray with respect to the said substantially annular part. As shown in FIG. 4, the eyelet 25 consists of a ring **25*a* identical to the eyelet 26 and of a rib 25*b* offset towards the front with respect to the ring 25*a***.

Figure 3:
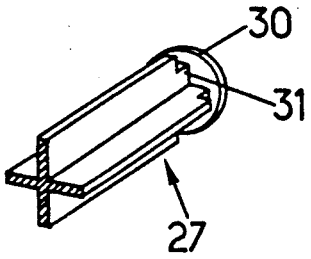
FIG. 3 is a detailed view of the part III of FIG. 1.

With reference to FIGS. 1 and 3, the structure of the hook 3 will now be described, it being understood that all the hooks 3, 4 and 5 are identical.

The hook 3 is in the form of an elongated U, with two identical and substantially parallel branches 27 and 28. The branches 27 and 28 are joined by a bar 29 which is perpendicular to them and the joining corners of which are rounded. Each branch 27, 28 has a regular and constant section and a length preferably slightly greater than half an upper rim of a lateral tray wall. As can be seen in FIG. 3, the branch 27 of the hook comprises a frustoconical head 30 followed by a narrowed part 31 and a straight part having, in section, a regular and constant cross shape. The branch 28 is identical.

The trays 1 and 2 can be nested in one another. The nesting of the upper tray 1 in the lower tray 2 is effected easily, without using hooks 3, 4 and 5, by virtue of the walls being slightly splayed towards the top of the two trays. In the nested position, the front frame 10 of the upper tray 1 is offset towards the front with respect to that of the lower tray 2. It is thus possible to nest a plurality of trays in order to form a stack, which reduces the space occupied by the unused trays.

The trays 1 and 2 can be stacked on top of one another. The stacking of the trays 1 and 2 is performed by means, on the one hand, of the locking elements 17 and 18 of the upper tray 1 cooperating with the upper end of the wings 11 and 12 equipped with the slots 19 and 20 of the lower tray 2, and, on the other hand, of two hooks 5, one of which is shown, which cooperate with the lower housings consisting of the eyelets 23, 24 of the upper tray 1 and the upper housings consisting of the eyelets 25, 26 of the lower housing 2. When the trays 1 and 2 are thus stacked on top of one another, the lugs **17*b* and 18*b* of the upper tray 1 are introduced into the slots 19 and 20 of the lower tray 2, respectively. The depressions 17*a* and 18*a* of the upper tray 1 rest directly on the upper end, which has substantially the same profile, of the wings 11 and 12 of the lower tray 2. The branches 32 and 33 of the hook 5 are located in the lower housing 23, 24 of the upper tray 1 and the upper housing 25, 26 of the lower tray 2, respectively, the hook 5 being introduced into these housings from the rear towards the front of the trays. The narrowed parts 31 of the branches 32, 33 of the hooks 5 cooperate with the ribs of the central eyelets 23 and 25, identical or otherwise to the rib 25*b* shown in FIG. 4**, in order to prevent any excessive displacement of the said branches in their housings.

The L-shaped lugs **17*b* and 18*b* of the upper tray 1 which are introduced inside the slots 19 and 20 of the lower tray 2 also play a securing role by means of their horizontal part cooperating with the upper end of the wings 11 and 12 of the lower tray 2. It is therefore possible not only to stack the trays 1 and 2, but also to suspend the lower tray 2 below the upper tray 1, on the one hand, by virtue of the hooks 5 and, on the other hand, by virtue of the lugs 17*b*, 18*b* of the tray 1. It is therefore possible to suspend the trays 1 and 2** below one another.

As shown in FIG. 1, the suspending of the tray 1 under a horizontal board 40 is performed via two identical hooks 3 and 4. The lower branches 28 and 35 of the hooks 3 and 4 are introduced into the openings 21 and 22 of the front frame 10 of the tray 1 from the front towards the rear of the tray. The upper branches 27 and 34 of the hooks 3 and 4 are placed on top of the board 40. The inner concave face of the upper rims 13 and 14 of the tray 1 serves as a bearing surface for the branches 28 and 35 of the hooks 3 and 4. The upper face of the board 40 serves as a bearing surface for the branches 27 and 34 of the hooks 3 and 4. The board 40 thus supports the weight of the tray 1 via the hooks 3 and 4. The ribs of the central eyelets 25 of the upper rims 13 and 14 cooperate with the narrowed parts of the branches 28 and 35 and limit their excessive displacement in the suspended position of the tray. It is then possible to suspend a plurality of trays below one another under the board 40.

The upper rims 13 and 14 of the tray 1 may have vertical perforations enabling the tray to be fixed under the board 40 or a similar supporting element by means of screws. It is thus possible to increase the potential uses of the trays fixed below a supporting element without using hooks as suspending elements, since the distance between two parallel branches of the elongated U-shaped hooks permits the suspending of the trays solely under boards of defined thickness.

The example has been given in order to explain the nesting, the stacking and the suspending of two trays on top of one another. By the same principle, it is possible to assemble, by nesting, stacking and/or suspending, a plurality of trays on top of one another. By virtue of the particular shape of the front frame of the trays, it is possible to achieve a regular piling of trays with an aesthetic vertical front face. The base equipped with its connecting edges of convex outer profile allows efficient cleaning of the tray. The stacking of two trays requires only two elongated U-shaped hooks. Moreover, the regular and symmetrical shape of the hooks permits very easy assembly of the trays. In addition, in the stacked position, the upper tray has its front frame resting directly on the upper ends of the wings of the front frame of the tray immediately below, which enables the storage device to support considerable weights.

I claim:

1. Storage device comprising a plurality of identical trays, substantially parallelepipedal in shape, which can be nested and stacked in a secure manner on top of one another and suspended below a horizontal supporting element, means of assembly for stacking and/or suspending the trays, each said tray comprising a horizontal base surrounded by lateral walls and a rear wall and a U-shaped front frame, said front frame having wings forming front ends of said lateral walls, said wings having upper and lower ends, said storage device further comprising means of assembly comprising removable connecting members and locking elements integral with the upper and lower ends of said wings of the front frame of the tray, so that stacking in a secure manner of two of said trays is performed by said locking elements cooperating with one another and by inserting the removable connecting members in the vicinity of the rear wall of each of the two trays.

2. Storage device according to claim 1, wherein the removable connecting members are identical elongated U-shaped hooks said U-shaped hooks forming substantially parallel branches, and wherein the lateral walls of the trays each comprise on an outer side, a horizontal upper housing and a horizontal lower housing in order to receive the branches of the U-shaped hooks, so as to stack two trays using only two of said U-shaped hooks which cooperate with the lateral sides of side trays, the branches of each said U-shaped hook being introduced form the rear side into the lower housing of an upper one of the two trays and into the upper housing of a corresponding lower one of the two trays.

3. Storage device according to claim 2, wherein each lateral wall is equipped at an upper end with an upper rim curved back towards the outside of the tray, and wherein the wings of the front frame are each equipped at an upper part with a front opening which permits the reception one of the substantially parallel branches of one of the U-shaped hooks, so as to permit the suspension of the tray under said horizontal supporting element by means of two of said U-shaped hooks, each said U-shaped hook cooperating with the upper rim of one of the lateral walls through a corresponding front opening and with the upper surface of the horizontal supporting element.

4. Storage device according to any of claims 2 or 3, wherein each said tray has rounded connecting edges joining the base and the lateral walls, said connecting edges each having a concave face serving as a bearing surface for the branch of the U-shaped hook introduced into the lower housing.

5. Storage device according to any of claims 2 or 3, wherein each of said substantially parallel branches comprises a frustoconical head followed by a narrowed part and a straight part of regular and constant section, and wherein the housing on the lateral walls of the trays have a circular section and are equipped with ribs (25*b*) preventing excessive displacement of the U-shaped hooks in the housings.

6. Storage device according to claim 3, wherein the front frames of the trays each contain a depression at each lower corner which, during assembly of the trays, rests on the corresponding upper rim of the lower tray, said upper rim serving as a bearing surface.

7. Storage device according to claim 6, wherein the front frame contains in each said depression an L-shaped vertical lug and at the upper end of each said wing a slot cooperating with one of the lugs of the upper tray, so that a horizontal part of the L-shaped lug is introduced inside the slot and contributes to the suspension of the lower tray.

8. Storage device according to claim 3, wherein the upper rims of the lateral walls of each tray are equipped with vertical perforations, so that any tray can be fixed to a lower surface of the supporting element by means of screws cooperating with said perforations.

9. Storage device according to any one of claims 1–3, wherein said storage device is made of moulded plastic and said locking elements are integrally moulded therein.

* * * * *